US011533576B2

(12) United States Patent
Desmet et al.

(10) Patent No.: US 11,533,576 B2
(45) Date of Patent: Dec. 20, 2022

(54) METHOD AND SYSTEM FOR LIMITING SPATIAL INTERFERENCE FLUCTUATIONS BETWEEN AUDIO SIGNALS

(71) Applicant: CAE INC., Saint-Laurent (CA)

(72) Inventors: Laurent Desmet, Saint-Laurent (CA); Maxime Ayotte, Saint-Laurent (CA); Marc-Andre Giguere, Saint-Laurent (CA)

(73) Assignee: CAE INC., Saint-Laurent (CA)

( * ) Notice: Subject to any disclaimer, the term of this patent is extended or adjusted under 35 U.S.C. 154(b) by 0 days.

(21) Appl. No.: 17/301,192

(22) Filed: Mar. 29, 2021

(65) Prior Publication Data

US 2022/0312140 A1 Sep. 29, 2022

(51) Int. Cl.

| | |
|---|---|
| ***H04S 7/00*** | (2006.01) |
| ***H04S 1/00*** | (2006.01) |
| ***H04R 5/02*** | (2006.01) |
| ***H04R 3/12*** | (2006.01) |

(52) U.S. Cl.

CPC ..... *H04S 7/30* (2013.01); *H04R 3/12* (2013.01); *H04R 5/02* (2013.01); *H04S 1/007* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,615,392 | B1 * | 12/2013 | Goodwin | H04R 3/12 381/337 |
| 2006/0111903 | A1 * | 5/2006 | Kemmochi | G10H 1/0091 704/244 |
| 2011/0173005 | A1 * | 7/2011 | Hilpert | G10L 19/008 704/500 |
| 2011/0216926 | A1 * | 9/2011 | Riggs | H04R 5/02 381/300 |
| 2011/0254625 | A1 * | 10/2011 | Kohut | H03F 1/0222 330/251 |
| 2011/0255714 | A1 * | 10/2011 | Neusinger | G10L 19/008 381/119 |
| 2015/0003621 | A1 | 1/2015 | Trammell | |
| 2015/0078571 | A1 * | 3/2015 | Kurylo | H04M 3/568 381/71.8 |
| 2017/0265004 | A1 * | 9/2017 | Shimazu | H04N 5/60 |
| 2018/0192220 | A1 * | 7/2018 | Chuang | H04S 7/308 |

FOREIGN PATENT DOCUMENTS

CA 2799890 A1 12/2012

* cited by examiner

*Primary Examiner* — Duc Nguyen
*Assistant Examiner* — Assad Mohammed
(74) *Attorney, Agent, or Firm* — Fasken Martineau Dumoulin, LLP

(57) ABSTRACT

A method for generating sound within a predetermined environment, the method comprising: emitting a first audio signal from a first location; and concurrently emitting a second audio signal from a second location, wherein: the first location and second location are distinct within the environment; the first audio signal and second audio signal have the same frequency; and the first audio signal and second audio signal have a phase difference that varies as a function of time to limit the time-averaged interference fluctuation across the environment.

20 Claims, 4 Drawing Sheets

METHOD AND SYSTEM FOR LIMITING SPATIAL INTERFERENCE FLUCTUATIONS BETWEEN AUDIO SIGNALS

TECHNICAL FIELD

The present technology relates to the field of sound processing, and more particularly to methods and systems for generating sound within a predetermined environment.

BACKGROUND

Vehicle simulators are used for training personnel to operate vehicles to perform maneuvers. As an example, aircraft simulators are used by commercial airlines and air forces to train their pilots to face various types of situations. A simulator is capable of artificially recreating various functionalities of an aircraft and reproducing various operational conditions of a flight (e.g., takeoff, landing, hovering, etc.). Thus, in some instances, it is important for a vehicle simulator to reproduce the internal and external environment of a vehicle such as an aircraft as accurately as possible by providing sensory immersion, which includes reproducing visual effects, sound effects (e.g., acceleration of motors, hard landing, etc.), and movement sensations, among others.

In the case of sound assessment, the location of a microphone to be used for sound tests or calibration is usually important to ensure repeatability such as when running sound Qualification Test Guide (QTG) tests. There are also requirements that certain frequency bands correspond to a certain amplitude, which must be contained within a certain tolerance range. For example, a QTG may require that for a minimum time period of 20 seconds, the average power in a given frequency band must be equal to a predetermined quantity.

If when running sound tests the microphone is positioned at a location different from previous positions, there will be a difference in travel distance between the speakers and the microphone that may cause a dephasing of the periodic signals which will cause different interferences and modify the recorded signal amplitudes so that the amplitude of the sound varies spatially within the simulator. The interferences and modifications in amplitude cause spatial variation of recorded sounds.

Therefore, there is a need for a method and system for limiting spatial interference fluctuations between audio signals within an environment.

SUMMARY

Developer(s) of the present technology have appreciated that a variation in the position of a user within a simulator may result in the user moving from a constructive interference area to a destructive interference area and vice versa, which may cause fluctuations in the sound heard by the user. If the fluctuations are above an allowed tolerance range, regulating authorities may not qualify the simulator, which could cause delay, increase costs and lead engineers to follow false trails for solving the problem.

Developer(s) have thus realized that phase modulation of audio signals could be used, such that the fluctuations of the spatial average energy inside the cockpit be minimized.

Thus, it is an object of one or more non-limiting embodiments of the present technology to diminish or avoid the effect of spatial sound interferences within a given environment such as a simulator environment.

According to a first broad aspect, there is provided a method for generating sound within a predetermined environment, the method comprising: emitting a first audio signal from a first location; and concurrently emitting a second audio signal from a second location, wherein: the first location and second location are distinct within the environment; the first audio signal and second audio signal have the same frequency; and the first audio signal and second audio signal have a phase difference that varies as a function of time to limit the time-averaged interference fluctuation across the environment.

In one embodiment, an amplitude of the first audio signal is identical to an amplitude of the second audio signal.

In one embodiment, the phase difference varies continuously as a function of time.

In one embodiment, a variation rate of the phase difference is constant in time. In another embodiment, the variation rate of the phase difference varies as a function of time.

In one embodiment, the phase difference is comprised between zero and $2\pi$.

In one embodiment, the second audio signal is identical to the first audio signal prior to the phase difference being added to the second audio signal.

In one embodiment, the second audio signal is generated before being emitted by receiving the first audio signal and adding the phase difference to the received first audio signal.

According to another broad aspect, there is provided a system for generating sound within a predetermined environment, the system comprising: a first sound emitter for emitting a first audio signal from a first location; and a second sound emitter for emitting a second audio signal from a second location; wherein: the first location and second location are distinct within the environment; the first audio signal and second audio signal have the same frequency; and the first audio signal and second audio signal have a phase difference that varies as a function of time to limit the time-averaged interference fluctuation across the environment.

In one embodiment, an amplitude of the first audio signal is identical to an amplitude of the second audio signal.

In one embodiment, the system further comprises a controller for transmitting the first audio signal to the first audio emitter and the second audio signal to the second sound emitter.

In one embodiment, the controller is configured to vary the phase difference continuously as a function of time.

In one embodiment, the controller is configured for varying the phase difference so that a variation rate of the phase difference be constant in time. In another embodiment, the controller is configured for varying the phase difference so that a variation rate of the phase difference varies as a function of time.

In one embodiment, the phase difference is comprised between zero and $2\pi$.

In one embodiment, the second audio signal is identical to the first audio signal prior to the phase difference be added to the second audio signal.

In one embodiment, the controller is further configured to: receive the first audio signal and transmit the first audio signal to the first sound emitter; add the phase difference to the first audio signal, thereby obtaining the second audio signal; and transmitting the second audio signal to the second sound emitter.

According to a further broad aspect, there is provided a non-transitory computer program product for generating sound within a predetermined environment, the computer program product comprising a computer readable memory storing computer-executable instructions thereon that when executed by a computer perform the method steps of: transmitting a first audio signal to be emitted from a first location; and concurrently transmitting a second audio signal to be emitted from a second location, wherein: the first location and second location are distinct within the environment; the first audio signal and second audio signal have the same frequency; and the first audio signal and second audio signal have a phase difference that varies as a function of time to limit the time-averaged interference fluctuation across the environment.

In one embodiment, an amplitude of the first audio signal is identical to an amplitude of the second audio signal.

In one embodiment, the phase difference varies continuously as a function of time.

In one embodiment, a variation rate of the phase difference varies as a function of time.

In one embodiment, the computer-executable instructions are further configured to perform the step of adding the phase difference to the first audio signal to generate the second audio signal before said emitting the second audio signal.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

Figure 1:
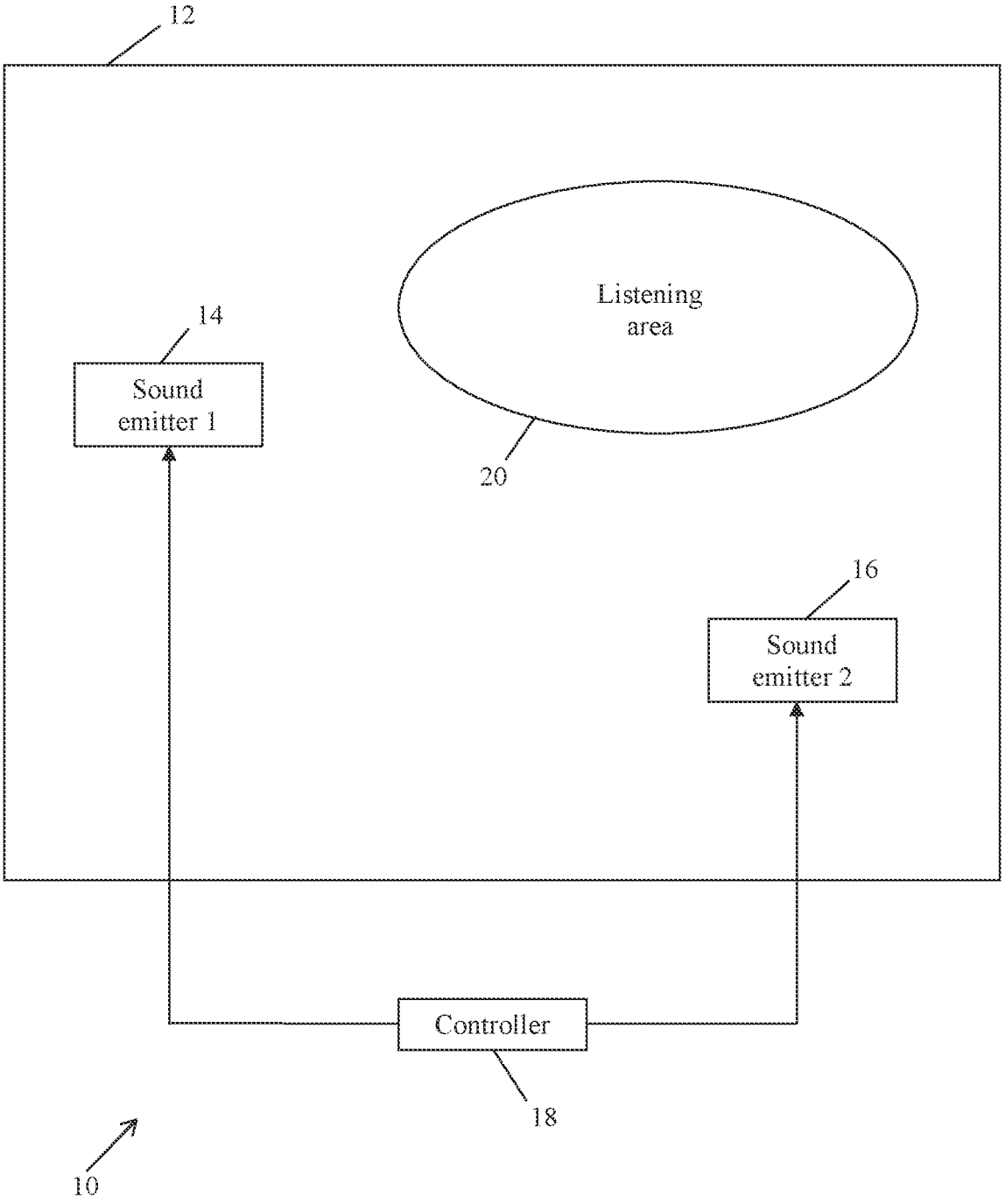
FIG. 1 is a conceptual diagram illustrating a system comprising two sound emitters and a controller for emitting two sound signals in accordance with an embodiment of the present technology.

FIG. 1 schematically illustrates a system 10 for emitting sound within a predetermined environment 12 such as within the interior space of a simulator. The system 10 comprises a first sound or audio emitter 14, a second sound or audio emitter 16 and a controller 18. The first and second sound emitters 14 and 16 are positioned at different locations within the environment 12 and oriented so as to propagate sound towards a listening area 20.

The controller 18 is configured for transmitting a first sound, acoustic or audio signal to the first sound emitter 14 and a second sound, acoustic or audio signal to the second sound emitter 16, and the first and second audio signals are chosen so as to at least limit interference fluctuations between the first and second audio signals within the listening area 20 of the environment 12. In one embodiment, the spatial interference fluctuations between the first and second audio signals may be mitigated within substantially the whole environment 12.

In one embodiment, the first and second audio signals may reproduce sounds that would normally be heard if the user of the system 10 would be in the device that the predetermined environment 12 simulates. For example, when the predetermined environment 12 corresponds to an aircraft simulator, the first and second sound emitters 14 and 16 may be positioned on the left and right sides of the seat to be occupied by a user of the aircraft simulator and the first sound emitter 14 may be used to propagate the sound generated by a left engine of an aircraft while the second sound emitter 16 may be used to propagate the sound generated by the right engine of the aircraft. The present system 10 may then improve the quality of the global sound heard by the user by mitigating interference fluctuations between the sounds emitted by the first and second sound emitters 14 and 16 within the aircraft simulator.

Referring back to FIG. 1, the controller 18 is configured for controlling the first and second emitters 14 and 16 so that the first audio signal and the second audio signal be emitted concurrently by the first sound emitter 14 and the second sound emitter 16, respectively, i.e. so that the first and second audio signals be concurrently heard by a user positioned within the listening area 20 of the environment 12.

The first and second audio signals are chosen or generated so as to have the same frequency or the same range of frequencies. The first and second audio signals are further chosen or generated so as to have a difference of phase (hereinafter referred to as phase difference) that varies in time so as to limit the time-averaged spatial interference fluctuation within the environment 12, or at least within the listening area 20 of the environment 12.

In one embodiment, the amplitude of the first signal emitted by the first sound emitter 14 is identical to the amplitude of the second audio signal emitted by the second sound emitter 16. In the same or another embodiment, the amplitude of the first signal within the listening area 20 or at a given position within the listening area 20 is identical to the amplitude of the second audio signal within the listening area 20 or at the given position within the listening area 20.

In one embodiment, the controller 18 is configured for modulating or varying in time the phase of only one of the first and second audio signals. In another embodiment, the controller 18 is configured for varying the phase in time of each audio signal as long as the phase difference between the first and second audio signals still varies as a function of time.

In one embodiment, the controller 18 is configured for modulating the phase of at least one of the first and second audio signals so that the phase difference between the first and second audio signals varies continuously as a function of time. For example, the phase of the first audio signal is maintained constant in time by the controller 18 while the phase of the second audio signal is modulated in time by the controller 18 so that the phase difference between the first and second audio signals varies continuously as a function of time. In another embodiment, the controller 18 is configured for varying the phase difference between the first and second audio signals in a stepwise manner, e.g. the phase difference between the first and second audio signals may be constant during a first short period of time and then varies as a function of time before being constant during a second short period of time, etc.

In an embodiment in which the phase difference between the first and second audio signals varies continuously as a function of time, the rate of variation for the phase difference is constant in time. Alternatively, the rate of variation for the phase difference between the first and second audio signals may also vary as a function of time as long as the first and second audio signals have a different phase in time.

In one embodiment, the rate of variation of the phase difference is comprised between about 0.005 Hz and about 50 Hz, which corresponds to a period of variation comprised between about 20 ms and 20 sec. The person skilled in the art will understand that a faster modulation will lead to more audible artifact, while a slower modulation will increase time-averaged interference fluctuations.

It should be understood that any adequate variation function may eb used. For example, the variation function may be a sine function. In another example, the variation function may be a pseudo-random variation function that is updated periodically such as at every 10 ms. In this case, the faster the variation is performed, the lower the range of the randomness change can be.

In one embodiment, the first and second audio signals may be identical except for their phase (and optionally their amplitude). In this case, the controller 18 is configured for generating an audio signal or retrieving an audio signal from a memory and varying the phase of the audio signal such as by adding the phase difference to the audio signal to obtain a phase modified audio signal. One of the first and second audio signals then corresponds to the unmodified audio signal while the other one of the first and second audio signals corresponds to the phase modified audio signal. For example, the unmodified audio signal may be the first audio signal to be emitted by the first sound emitter 14 and the phase modified audio signal may be the second audio signal to be emitted by the second sound emitter 16.

It will be understood that the sound emitter 14, 16 may be any device adapted to convert an electrical audio signal into a corresponding sound, such as a speaker, a loudspeaker, a piezoelectric speaker, a flat panel loudspeaker, etc.

In one embodiment, the controller 18 is a digital device that comprises at least a processor or processing unit such as digital signal processor (DSP), a microprocessor, a microcontroller or the like. The processor or processing unit of the controller 18 is operatively connected to a non-transitory memory, and a communication unit. In this case, the processor of the controller 18 is configured for retrieving the first and second audio signals from a database stored on a memory. In this case, the system 10 further comprises a first digital-to-analog converter (not shown) connected between the controller 18 and the first sound emitter 14 for converting the first audio signal transmitted by the controller 18 from a digital form into an analog form to be played back by the first sound emitter 14. The system 10 also comprises a second digital-to-analog converter (not shown) connected between the controller 18 and the second sound emitter 16 for converting the second audio signal transmitted by the controller 18 from a digital form into an analog form to be played back by the second sound emitter 16.

In an embodiment in which the controller 18 is digital, the controller 18 is configured for generating the first and second audio signals having a phase difference that varies in time.

In another embodiment in which the controller 18 is digital, the controller 18 is configured for retrieving the first and second audio signals from a database and optionally vary the phase of at least one of the first and second audio signals to ensure that the first and second audio signals have a phase difference that varies in time. For example, the controller may retrieve an audio signal from the database and modify the phase in time of the retrieved audio signal to obtain a phase-modified audio signal. The unmodified signal is transmitted to one of the first and second sound emitter 14 and 16 and the phase-modified audio signal is transmitted to the other, via the first and second digital-to-analog converters.

It will be understood that the controller 18 is further configured for controlling the emission of the first and second audio signals so that first and second audio signals be concurrently emitted by the first and second sound emitters 14 and 16 and/or concurrently received within the listening area 20. Since the distance between the sound emitters 14 and 16 and the listening area 20 is usually in the order of meters, audio signals that are concurrently emitted by the sound emitters 14 and 16 are usually concurrently received in the listening area 20 so that emitting concurrently sound signals by the sound emitters 14 and 16 is equivalent to concurrently receiving the emitted sound signals in the listening area 20.

In another embodiment, the controller 18 is an analog device comprising at least one phase modulation device for varying in time the phase of at least one analog audio signal. For example, the analog controller 18 may receive the first audio signal in an analog format and transmit the first audio signal to the first sound emitter 14, and may receive the second audio signal in an analog format, vary the phase of the second audio signal so as to ensure a phase difference in time with the first audio signal and transmit the second audio signal to the second sound emitter 16. In another example, the analog controller 18 may receive a single analog audio signal and transmit the received analog audio signal directly to the first sound emitter 14 so that the first audio signal corresponds to the received analog audio signal. In this case, the analog controller is further configured for creating a phase modified copy of the received audio signal, i.e. the second audio signal, by varying the phase of the received analog audio signal and for transmitting the phase modified analog audio signal to the second sound emitter 16.

In one embodiment, the analog controller 18 comprises at least one oscillator for varying the phase of an audio signal. For example, the analog controller 18 may comprise a voltage-controlled oscillator (VCO) of which the voltage varies slightly around a desired frequency since a frequency variation triggers a phase variation. In another example, the analog controller 18 may comprise a first VCO and a second VCO connected in series. The first VCO is then used a time-varying frequency signal while the second VCO is used to generate the audio signal. The second VCO receives the time-varying frequency signal and a DC signal as inputs to generate an audio signal, the phase of which varies in time.

In one embodiment, the phase difference in time between the first and second audio signals is comprised within the following range: $[0; 2\pi]$. In a further embodiment, the range of variation of the phase may be arbitrarily chosen. For example, the phase difference in time between the first and second audio signals may be comprised within the following ranges: $[0; \pi/2]$, $[1.23145, 2]$, etc.

In one embodiment, the range of variation of the phase difference between the first and second audio signals is chosen to be small enough to limit the subjective impact.

The present system 10 uses phase modulation of at least one audio signal to limit the spatial fluctuations of time-averaged interferences between the first and second audio signals. This is achieved by ensuring that the phase difference between the first and second audio signals varies in time.

Figure 2:
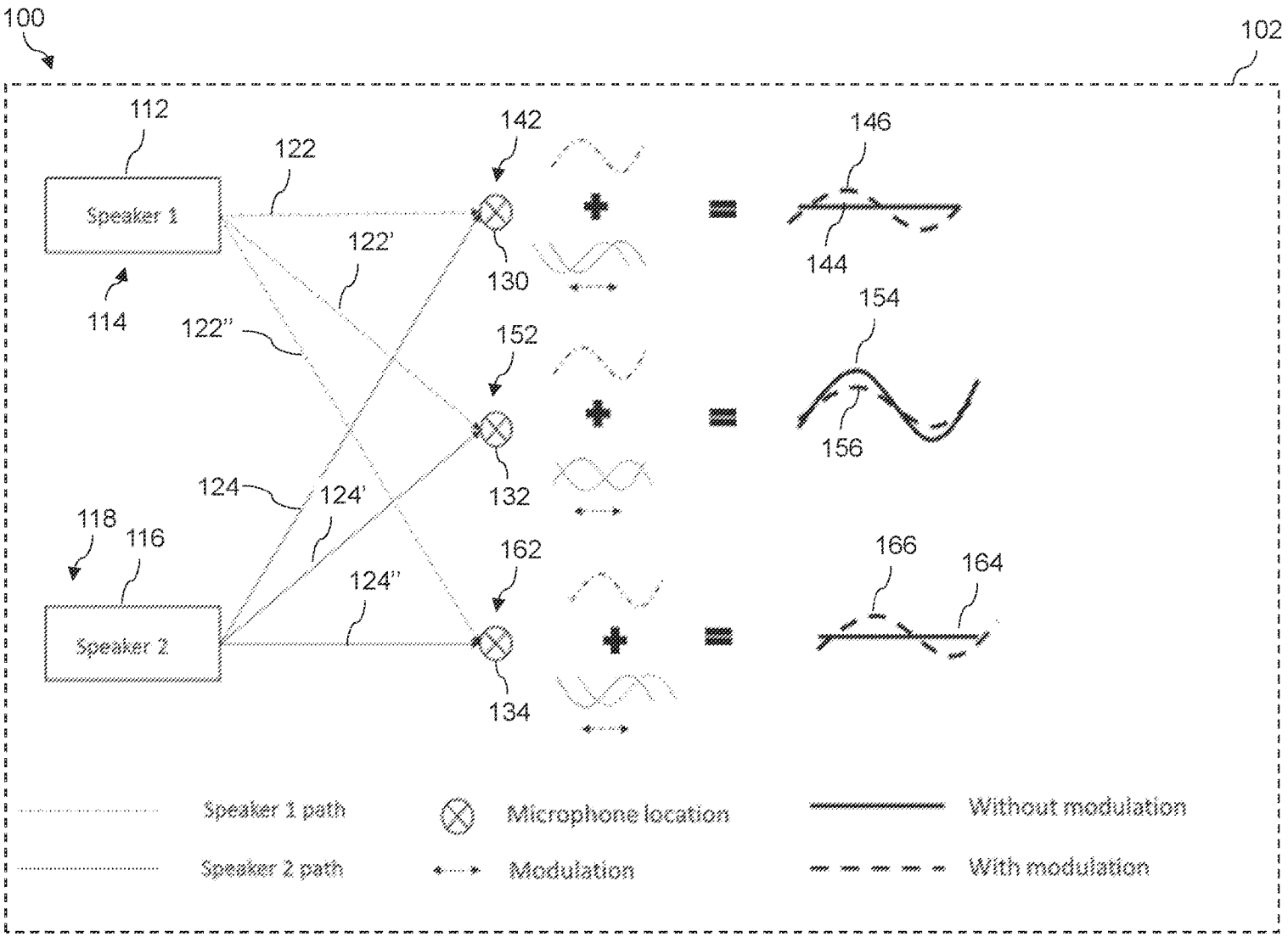
FIG. 2 schematically illustrates the mitigation of time-averaged interference fluctuations at three different locations within an environment when a constant-phase audio signal and a phase-modulated audio signal are emitted.

FIG. 2 schematically illustrates an exemplary limitation of time-averaged interference fluctuation across an environment that may be achieved using the present technology.

A system 100 comprises a first sound emitter 112 such as a first speaker, a second sound emitter 116 such as a second speaker and a controller or playback system 110 for providing audio signals to be emitted by the first and second sound emitters 112 and 116. Three microphones 130, 132 and 134 are located at different locations within an environment 102 to detect the sound received at the three different locations. In the illustrated embodiment, the first, second and third microphones 130, 132 and 134 are located at the locations 142, 152 and 162, respectively, within the environment 102.

In one embodiment, the environment 102 is a closed space or a semi-closed space such as a vehicle simulator. As non-limiting examples, the vehicle simulator may be a flight simulator, a tank simulator, a helicopter simulator, etc.

The first sound emitter 112 is located at a first location 114 within the environment 102. The first emitter 112 is operable to emit a first audio signal which propagates within the environment 102. A first portion 122 of the first audio propagates up to the first microphone 130, a second portion 122' of the first audio signal propagates up to the second microphone 132 and a third portion 122" propagates up to the third microphone 134.

The first location 114 of the first sound emitter 112 is a fixed position within the environment 102 and does not vary in time. In one embodiment, the position of the first sound emitter 112 is unknown while being constant in time. In another embodiment, the position of the first emitter 112 is known and constant in time.

The second sound emitter 116 is located at a second location 118 within the environment 102. The second location 118 is distinct from the first location 112 so that the first and second sound emitters 112 and 116 are spaced apart. Similarly to the first sound emitter 112, the second sound emitter 116 is operable to emit a second audio signal which propagates within the environment 102. A first portion 124 of the second audio propagates up to the first microphone 130, a second portion 124' of the second audio signal propagates up to the second microphone 132 and a third portion 124" propagates up to the third microphone 134.

The second location 118 of the second emitter 116 is a fixed position within the environment 102 and does not vary in time. In one embodiment, the position of the second emitter 116 is unknown while being constant in time. In another embodiment, the position of the second emitter 116 is known and constant in time.

The first and second audio signals are chosen so as to have the same frequency, i.e., at each point in time, the first and second audio signals have the same frequency. In one embodiment, the first and second audio signals have the same amplitude, i.e., at each point in time, the first and second audio signals have the same amplitude. In another embodiment, the first and second audio signals have different amplitudes, i.e., for at least some points in time, the first and second audio signals have different amplitudes.

The phase difference between the first and second audio signals varies in time. In the illustrated embodiment, the phase of the first audio signal emitted by the first sound emitter 112 is constant in time while the phase of the second audio signal varies in time to obtain the time-varying phase difference between the first and second audio signals. Therefore, the phase of the second audio signal is modulated as a function of time, i.e. a time-varying phase shift is applied to the second audio signal. It will be understood that the phase of the second audio signal could be constant in time while the phase of the first audio signal could vary in order to reach the time-varying phase difference between the first and second audio signals. In another example, a different time-varying phase shift may be applied to both the first and second audio signals so as to obtain the time-varying phase difference between the first and second audio signals.

As illustrated in FIG. 2, since the distance between the second sound emitter 116 and each microphone 130, 132, 134 is different, the propagation time of the second audio signal between the second sound emitter 116 and each microphone 130, 132, 134 is also different. Since the phase of the second audio signal varies as a function of time and since the propagation times are different, at each point in time the phase of the second audio signal is different at each location 142, 152 and 162 where a respective microphone 130, 132, 134 is positioned.

As illustrated in FIG. 2 and since the first and second audio signals have the same frequency, the first audio signal interferes or combines with the second audio signal to provide a third audio signal at each point of the environment 102 where the two audio signals propagate. At the location 142 where the first microphone 130 is positioned, the combination of the first and second audio signals generates a third sinusoidal audio signal 146. At the location 152 where the second microphone 132 is positioned, the combination of the first and second audio signals generates a fourth sinusoidal audio signal 156. At the location 162 where the third microphone 134 is positioned, the combination of the first and second audio signals generates a fifth sinusoidal audio signal 166. As illustrated in FIG. 2, the third, fourth and fifth audio signals 146, 156 and 166 are different.

The reference element 144 illustrated in FIG. 2 represents the audio signal that would result from the combination of the first and second audio signals at the location 142 if the phase of the second audio signal is not modulated in time. The reference element 154 represents the audio signal that would result from the combination of the first and second audio signals at the location 152 if the phase of the second audio signal is not modulated in time. The reference element 164 represents the audio signal that would result from the combination of the first and second audio signals at the location 162 if the phase of the second audio signal is not modulated in time.

From FIG. 2, the person skilled in the art will understand that the difference in amplitude between the audio signals 146, 156 and 166 (which are obtained by modulating the phase of the second audio signal) is less than the difference in amplitude between the audio signals 144, 154 and 164, which are obtained without modulating the phase of the second audio signal. As a result, the difference in amplitude over space of the audio signal resulting from the combination of the first and second audio signals is reduced in comparison to the case in which there is no phase modulation of the second audio signal, therefore limiting the time-averaged interference fluctuation across the environment 102, i.e., the fluctuation of the spatial average energy within the environment 102 is limited, thereby improving the sound rendering within the environment 102.

In one embodiment, the second audio signal is identical to the first audio signal except for the phase of the second audio signal which is modulated in time while the phase of the first audio signal is constant in time.

In one embodiment, the phase modulation applied to the second audio signal is random. In this case, the signal produced by the phase modulation may be expressed as in equation (1):

$$s(t)=\sin(2\pi f t+\theta(t)) \quad (1)$$

where θ(t) is a progressive random number generator such as a spline interpolation between two numbers of a distribution such as a uniform distribution [0, β] expressed as in equation (2):

$$\theta(t)=\beta\cdot\text{spline}(\text{rand}(t_i,t_{i+1})) \quad (2)$$

In one embodiment, a spline interpolation is used because a steep variation in θ may be audible.

While a spline interpolation is used in the above example, it should be understood that any smooth interpolation function can be used. For example, a linear interpolation function may be used.

The phase shift may be calculated by calculating 2πf·t(N), where N is the sample to retrieve from the vector t, which is calculated in a classic manner (t=(0:duration)/Fs). To calculate θ(N), M equally spaced points are generated, a Spline approximation is applied such that t and θ are equal, the two values are summed, and the corresponding sinus value is then calculated.

Figure 3A:
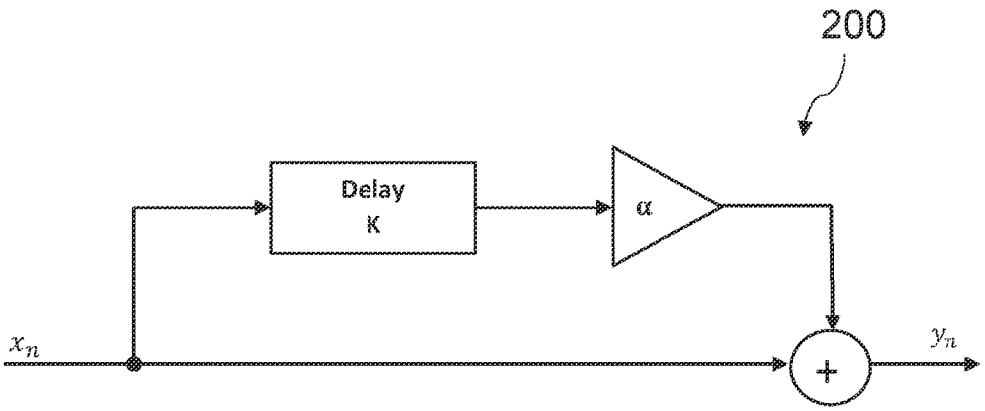
FIG. 3A illustrates a schematic diagram of a frequency response model in accordance with one or more non-limiting embodiments of the present technology.

FIG. 3A illustrates a schematic diagram of a frequency response model 200 in accordance with one or more non-limiting embodiments of the present technology.

In one embodiment, the frequency response of the present technology may be represented as a feed-forward comb filter. It will be appreciated that the feed-forward comb filter may be implemented in discrete time or in continuous time. A comb filter is a filter implemented by adding a delayed version of a signal to itself, causing constructive and destructive interference.

The difference equation representing the frequency response of the system 200 is expressed as equation (3):

$$y[n]=x[n]+\alpha x[n-K] \quad (3)$$

where K represents the delay length (measured in samples) and α is a scaling factor applied to the delayed signal.

Figure 3B:
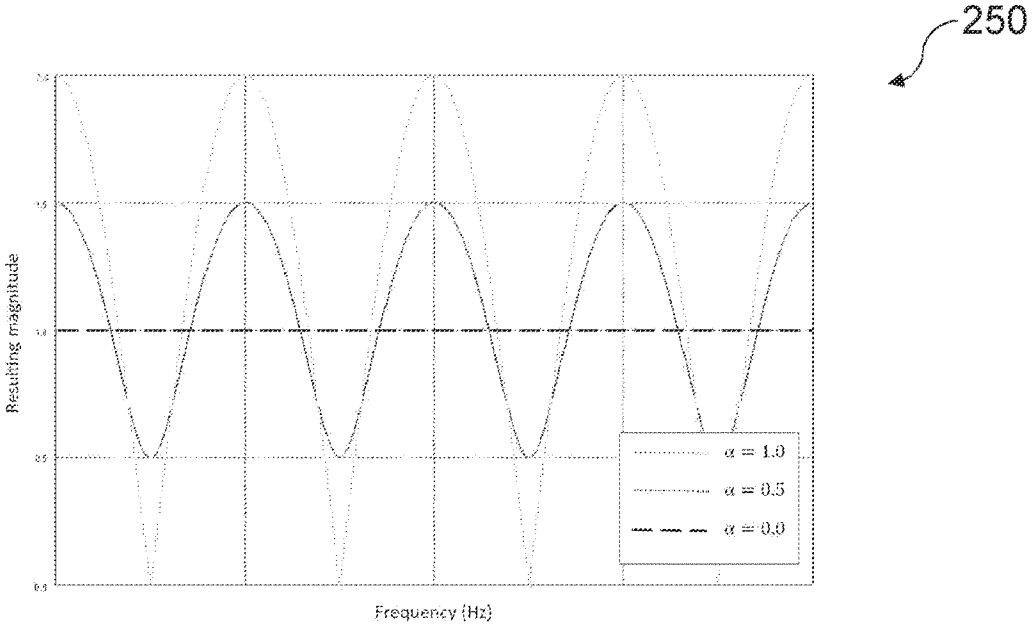
FIG. 3B illustrates a schematic diagram in accordance with one or more non-limiting embodiments of the present technology.

FIG. 3B illustrates an exemplary plot 250 of the magnitude of the transfer function with respect to the frequency for different values of the scaling factor.

It will be appreciated that the frequency response tends to drop around an average value (the variance of the values decreases), as a moves away from 1. Thus, this information about the scaling factor can be used for repeatability. Phase modulation can be used as a modulation pattern for conditioning communication signals for transmission, where a message signal is encoded as variations in the instantaneous phase of a carrier wave. The phase of a carrier signal is modulated to follow the changing signal level (amplitude) of the message signal. The peak amplitude and the frequency of the carrier signal are maintained constant, but as the amplitude of the message signal changes, the phase of the carrier changes correspondingly.

Thus, it is possible to adjust two parameters to adapt the phase modulation: a number of random samples during a recording cycle or recording frequency, and the interval on which the uniform distribution is sampled.

Figure 4:
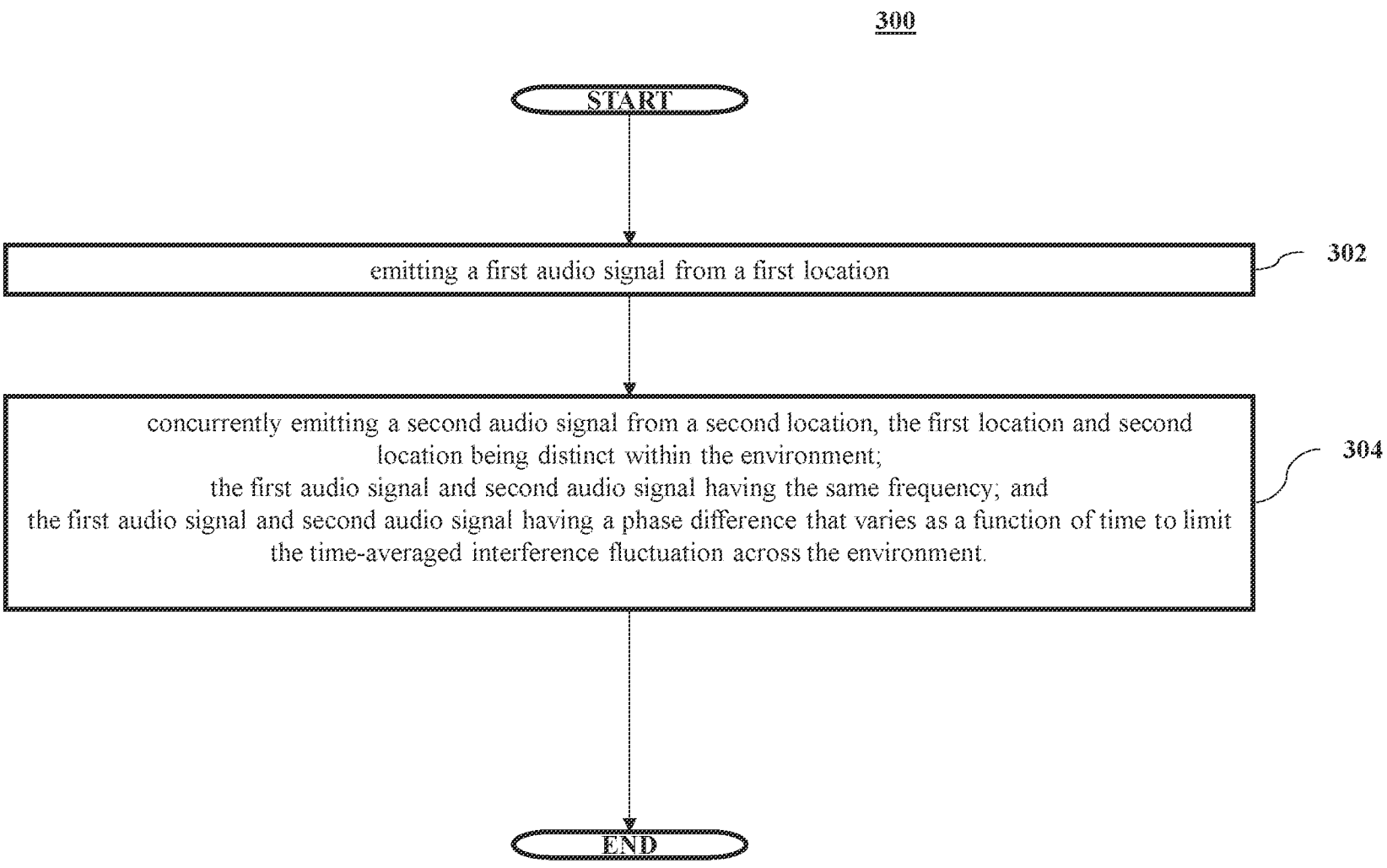
FIG. 4 illustrates a flow-chart of a method of limiting interference fluctuations between audio signals within an environment.

With reference to FIG. 4 there is illustrated an embodiment method 300 for limiting interference fluctuations between audio signals within an environment when at least two audio signals having the same frequency propagate within the environment.

At step 302, a first audio signal is emitted from a first location within the environment, the first audio signal having a first frequency. As a non-limiting example, a first sound emitter such as a speaker may be positioned at a first location within the environment to emit the first audio signal.

At step 304, a second audio signal is emitted from a second location within the environment concurrently with the emission of the first audio signal, the second audio signal having the same frequency as the first audio signal so that they may interfere with one another. As a non-limiting example, a second sound emitter such as a speaker may be positioned at the second location within the environment to emit the second audio signal.

The first and second audio signals are chosen so that the phase difference between the first and second audio signals varies as a function of time. In one embodiment, the phase of one of the first and the second audio signals is constant in time while the phase of the other is modulated as a function of time. In another embodiment, the phase of both the first and second audio signals may be modulated as a function of time as long as the phase difference between the first and second audio signals varies in time.

In one embodiment, the second audio signal is initially identical to the first audio signal, and a phase difference is added to the second audio signal before emission thereof, i.e. the phase of the second audio signal is modulated in time while the phase of the first audio signal remains constant in time.

In one embodiment, the phase difference between the first and second audio signals varies continuously as a function of time. In one or more other embodiments, the phase difference between the first and second audio signals varies as a function of time in a stepwise manner. In one or more alternative embodiments, the phase difference is constant as a function of time.

In one embodiment, the phase difference in time between the first and second audio signals is comprised within the following range: [0; 2π].

Thus, the first and second audio signals are emitted such that an amplitude difference across space of the signal resulting from the combination of the first and second audio signals is limited, which results in limited energy fluctuation across space. In one embodiment, the first and second audio signals may be emitted such that the fluctuation across space is within a predetermined fluctuation range. The fluctuations may be detected for example via one or more microphones positioned at different locations within an environment.

It will be appreciated that the first sound emitter and the second sound emitter may be operatively connected to one or more controllers which may be operable to transmit commands for generating concurrently the first and second audio signals, and for controlling amplitudes, frequencies, and phases of the first audio signal and the second audio signal. It is contemplated that a microphone may detect audio signals emitted by the first sound emitter and the second sound emitter and provide the audio signals to the one or more controllers for processing.

The method 300 is thus executed such that the time-averaged interference fluctuation across at least a portion the environment is limited, i.e. the fluctuation of the spatial average energy within at least a portion of the environment is limited.

In one embodiment, the method 300 further comprises receiving the first and second audio signals by a controller for example before the emission of the first and second audio signals. In one embodiment, the first and second audio signals are uploaded from a database stored on a non-volatile memory.

In another embodiment, the method 300 further comprises a step of generating the first audio signal and/or the second audio signal. In one embodiment, the method 300 comprises receiving a first audio signal, generating a second audio signal by varying the phase of the first audio signal in time, and concurrently emitting the first and second audios signals from different locations.

In one embodiment, a non-transitory computer program product may include a computer readable memory storing computer executable instructions that when executed by a processor cause the processor to execute the method 300. The processor may be included in a computer for example, which may load the instructions in a random-access memory for execution thereof.

While the technology has been described as involving the emission of two audio signals having a time-varying phase difference, it will be understood that more than two audio signals may be generated and emitted towards the listening area as long as a time-varying phase difference exists between at least two audio signals. In an example in which three audio signals, i.e. audio signals 1, 2 and 3, are emitted, a time-varying phase difference may exist between audio signals 1 and 2 and between audio signals 1 and 3, but not between audio signals 2 and 3. In another example, a first time-varying phase difference may exist between the audio signals 1 and 2, a second time-varying phase difference may exist between the audio signals 1 and 3, and a third time-varying phase difference may exist between the audio signals 2 and 3.

The one or more embodiments of the technology described above are intended to be exemplary only. The scope of the present technology is therefore intended to be limited solely by the scope of the appended claims.

We claim:

1. A method for generating sound within a predetermined environment, the method comprising:

emitting a first audio signal from a first location; and concurrently emitting a second audio signal from a second location, wherein:

the first location and second location are distinct within the environment;

the first audio signal and second audio signal have the same frequency; and the first audio signal and second audio signal have a phase difference that varies as a function of time to limit the time-averaged interference fluctuation across the environment.

2. The method of claim 1, wherein an amplitude of the first audio signal is identical to an amplitude of the second audio signal.

3. The method of claim 1, wherein the phase difference varies continuously as a function of time.

4. The method of claim 3, wherein a variation rate of the phase difference is constant in time.

5. The method of claim 3, wherein a variation rate of the phase difference varies as a function of time.

6. The method of claim 1, wherein the phase difference is comprised between zero and $2\pi$.

7. The method of claim 1, further comprising adding the phase difference to the first audio signal to generate the second audio signal before said emitting the second audio signal.

8. A system for generating sound within a predetermined environment, the system comprising:

a first sound emitter for emitting a first audio signal from a first location; and a second sound emitter for emitting a second audio signal from a second location;

wherein:

the first location and second location are distinct within the environment;

the first audio signal and second audio signal have the same frequency; and the first audio signal and second audio signal have a phase difference that varies as a function of time to limit the time-averaged interference fluctuation across the environment.

9. The system of claim 8, wherein an amplitude of the first audio signal is identical to an amplitude of the second audio signal.

10. The system of claim 8, further comprising a controller for transmitting the first audio signal to the first audio emitter and the second audio signal to the second sound emitter.

11. The system of claim 10, wherein the controller is configured for varying the phase difference continuously as a function of time.

12. The system of claim 11, wherein the controller is configured for varying the phase difference so that a variation rate of the phase difference be constant in time.

13. The system of claim 11, wherein the controller is configured for varying the phase difference so that a variation rate of the phase difference varies as a function of time.

14. The system of claim 8, wherein the phase difference is comprised between zero and $2\pi$.

15. The system of claim 10, wherein the controller is further configured to add the phase difference to the first audio signal to generate the second audio signal before transmitting the second audio signal to the second sound emitter.

16. A non-transitory computer program product for generating sound within a predetermined environment, the computer program product comprising a computer readable memory storing computer-executable instructions thereon that when executed by a computer perform the method steps of:

transmitting a first audio signal to be emitted from a first location; and concurrently transmitting a second audio signal to be emitted from a second location, wherein:

the first location and second location are distinct within the environment;

the first audio signal and second audio signal have the same frequency; and the first audio signal and second audio signal have a phase difference that varies as a function of time to limit the time-averaged interference fluctuation across the environment.

17. The non-transitory computer program product of claim 16, wherein an amplitude of the first audio signal is identical to an amplitude of the second audio signal.

18. The method of claim 16, wherein the phase difference varies continuously as a function of time.

19. The method of claim 18, wherein a variation rate of the phase difference varies as a function of time.

20. The method of claim 16, wherein the computer-executable instructions are further configured to perform the step of adding the phase difference to the first audio signal to generate the second audio signal before said emitting the second audio signal.

* * * * *